US008899733B2

(12) United States Patent
Kader et al.

(10) Patent No.: US 8,899,733 B2
(45) Date of Patent: Dec. 2, 2014

(54) METHOD FOR SUPPLYING AT LEAST ONE PRINT HEAD WITH INK IN AN INKJET PRINTER

(71) Applicants: Murat Kader, Munich (DE); Andreas Mueller, Baldham (DE)

(72) Inventors: Murat Kader, Munich (DE); Andreas Mueller, Baldham (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 13/922,662

(22) Filed: Jun. 20, 2013

(65) Prior Publication Data

US 2013/0342617 A1 Dec. 26, 2013

(30) Foreign Application Priority Data

Jun. 22, 2012 (DE) ..... 10 2012 105 423

(51) Int. Cl.
*B41J 2/175* (2006.01)
*B41J 29/393* (2006.01)

(52) U.S. Cl.
CPC ..... *B41J 2/175* (2013.01)
USPC ..... 347/85; 347/19

(58) Field of Classification Search
USPC ..... 347/7, 19, 84–87
See application file for complete search history.

(56) References Cited

U.S. PATENT DOCUMENTS

| | | | | |
|---|---|---|---|---|
| 4,677,448 | A * | 6/1987 | Mizusawa et al. | 347/85 |
| 4,800,839 | A | 1/1989 | Ariyama et al. | |
| 6,139,136 | A * | 10/2000 | Mackay et al. | 347/85 |
| 6,196,668 | B1 * | 3/2001 | Bode | 347/85 |
| 7,410,249 | B2 * | 8/2008 | Inoue | 347/89 |
| 7,988,272 | B2 * | 8/2011 | Takatsuka | 347/85 |
| 2008/0239027 | A1 | 10/2008 | Kinase et al. | |
| 2009/0295881 | A1 | 12/2009 | Tasaka et al. | |
| 2010/0103208 | A1 | 4/2010 | Asami et al. | |

FOREIGN PATENT DOCUMENTS

| | | | |
|---|---|---|---|
| DE | 3316970 | C2 | 11/1983 |
| DE | 3623251 | A1 | 3/1987 |
| EP | 0788882 | B1 | 7/2002 |
| JP | 2006-231607 | A | 9/2006 |

* cited by examiner

*Primary Examiner* — Anh T. N. Vo
(74) *Attorney, Agent, or Firm* — Schiff Hardin LLP

(57) ABSTRACT

In a system or method for supplying print bars with a plurality of print heads with ink in an inkjet printer, a pressure source is activated in a flushing procedure in order to exert an excess pressure to the ink in intermediate tanks supplying ink to the print bars such that the ink is flushed through jets of a print head to be flushed in the respective print bar. The pressure source is shut off when printing. The ink in the intermediate tanks is transported to the print heads by means by hydrostatic pressure. In the event of an overflow of the intermediate tanks, overflowing ink is transported into an overflow container via a respective pressure line connecting the overflow container to the respective intermediate container.

7 Claims, 3 Drawing Sheets

METHOD FOR SUPPLYING AT LEAST ONE PRINT HEAD WITH INK IN AN INKJET PRINTER

BACKGROUND

Inkjet printers can be used for single or multiple color printing of a printing substrate, e.g. a single sheet or a band-shaped recording medium made of different materials. The assembly of these inkjet printers is known, for example, from EP 0 788 882 B1. Inkjet printers which function according to the Drop on Demand (DoD) principle exhibit one print head or numerous print heads having jets comprising ink channels, the activators of which, controlled by a printer control, propel ink droplets toward a printing substrate in order to apply printer dots thereto to create a print image. The activators can generate print drops thermally (bubble jet) or by piezoelectric means.

In order to replace the ink used by a print head in printing, it is known from DE 33 16 970 C2 to dispose a supply chamber filled with ink next to the print head. A main container for ink is supplied for filling the supply chamber with ink, and which can be coupled to the supply chamber as needed in order to supply ink to the supply chamber. In order to prevent an overflow of ink in the supply chamber, a separating wall to an overflow chamber is disposed in the supply chamber. If the ink in the supply chamber overruns the separating wall, ink flows over the separating wall into the overflow chamber. From there, the ink can be returned to the main container, for example, when the supply chamber is coupled to the main container. The supplying of ink into the supply chamber and the removal of ink from the overflow chamber is obtained in each case by means of a pump. The height of the separating wall is selected such that the level of ink in the supply chamber exhibits a state such that the ink supply pressure at the jets of the print head is maintained at a constant level.

A multi-color printer is known from DE 36 23 251 A1with which successive print images of different colors can be printed using the same developer station. The dyes can be supplied to the developer station from a tank, which contains the respective dyes. The excess dyes can be returned to the dye tank via a rotatably mounted jet. When a color change is to be carried out, the developer station must be cleaned with a cleaning fluid between changes. Overflow holes are provided in the dye tanks, each of which is connected to an overflow tank.

With the known inkjet printer according to DE 33 16 970 C2, an intermediate tank (called a supply chamber) is thus provided, which supplies the print head with ink. The ink in the intermediate tank is subjected to pressure thereby, e.g. a hydrostatic pressure, such that the ink is supplied to the jets of the print head.

With lower print loads, not all of the jets of a print head are activated during a printing process, and numerous jets are inactive (printing breaks), with the result that the ink in the ink channel of those jets remains stationary. Due to the effect of evaporation from the jet opening, there is the risk that the viscosity of the ink then changes. This results in the ink in the ink channel no longer being able to flow in the optimal manner, and thus exit the jet. In extreme cases, the ink dries in the ink channel, and clogs the ink channel, such that a printing with this jet is no longer possible.

A drying up of the ink in the jets of a print head during the printing breaks presents a problem which can be prevented in that, within a given cycle, for example, a flushing medium, e.g. ink or cleaning fluid, can be flushed through the jets. This flushing cycle can, for example, be adjusted in accordance with the printing load.

The flushing process can be carried out using the ink in the intermediate tank, wherein the pressure applied to the ink in the intermediate tank can be generated using a pressure source, which is connected to the intermediate tank by means of a pressure line. When a printer exhibits numerous print heads, e.g. as in the case with color printing, an intermediate tank can be allocated to each print head. By this means, the necessary pressure can be generated in all of the intermediate tanks with a pressure source, wherein the pressure lines lead to the pressure source from all of the intermediate tanks. If, in this case, one of the intermediate tanks overflows, e.g. because too much ink was sent to the intermediate tank, there is the risk that ink from this intermediate tank will end up being sent, via the pressure lines, to the other intermediate tanks and print heads. This is particularly the case when the pressure source is shut off during the printing operation, and only the hydrostatic pressure provided for the printing is present in the intermediate tank.

SUMMARY

It is an object to provide a design and a method for supplying the print head of an inkjet printer with ink, in which the flushing of the jets of the print head can be carried out using a shared pressure source for generating an excess pressure in the intermediate tanks, and a return flow of ink from one intermediate tank to the other intermediate tanks is prevented.

In a system or method for supplying print bars with a plurality of print heads with ink in an inkjet printer, a pressure source is activated in a flushing procedure in order to exert an excess pressure to the ink in intermediate tanks supplying ink to the print bars such that the ink is flushed through jets of a print head to be flushed in the respective print bar. The pressure source is shut off when printing. The ink in the intermediate tanks is transported to the print heads by means by hydrostatic pressure. In the event of an overflow of the intermediate tanks, overflowing ink is transported into an overflow container via a respective pressure line connecting the overflow container to the respective intermediate container.

DESCRIPTION OF PREFERRED EXEMPLARY EMBODIMENTS

Figure 1:
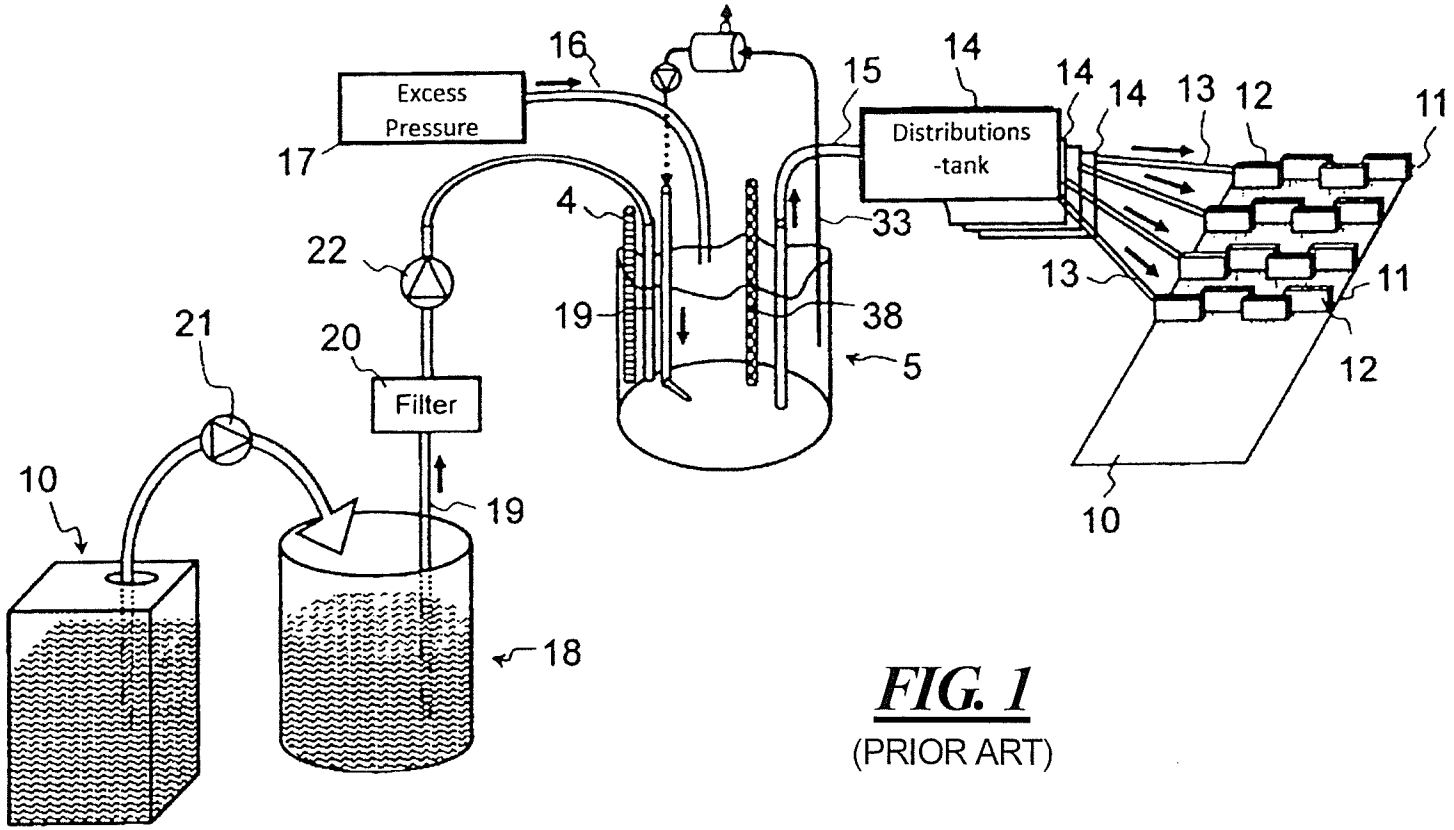
FIG. 1 (PRIOR ART)
FIG. 1 is a basic illustration of a supply device for a printer having print bars exhibiting numerous print heads.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

In order to avoid the above-described problem, which occurs particularly when the pressure source is shut off, an overflow container can be provided, to which the pressure lines from the intermediate tanks lead. The overflow container can be connected, in addition, to the pressure source by means of a shared pressure line, from which the compressed air can be supplied to the overflow container. If only one of the intermediate tanks overflows, the overflowing ink ends up in the overflow container via the pressure line, and is collected therein. By this means, it is first prevented that the ink is able to end up in the pressure lines of the other intermediate tanks.

If, in addition, a sensor is disposed on the overflow container, which determines whether the overflow container is full, the printing operation can be shut down before ink from the overflow container can flow into the pressure lines to the other intermediate tanks.

The method according to the exemplary embodiment thus exhibits the following advantages:

- In the case of a malfunction, the ink from the overflowing intermediate tank cannot mix with the ink from the other intermediate tanks.
- The wasted ink in the event of an overflow is slight, because a small amount of overflowing ink is sufficient for detecting the malfunction and stopping the printer, as well as generating an error message in the control panel.
- The printer can be restarted after minor cleaning work.
- The pressure system is not contaminated with ink. No components need to be replaced, which have been rendered unusable by ink.

Figure 2:
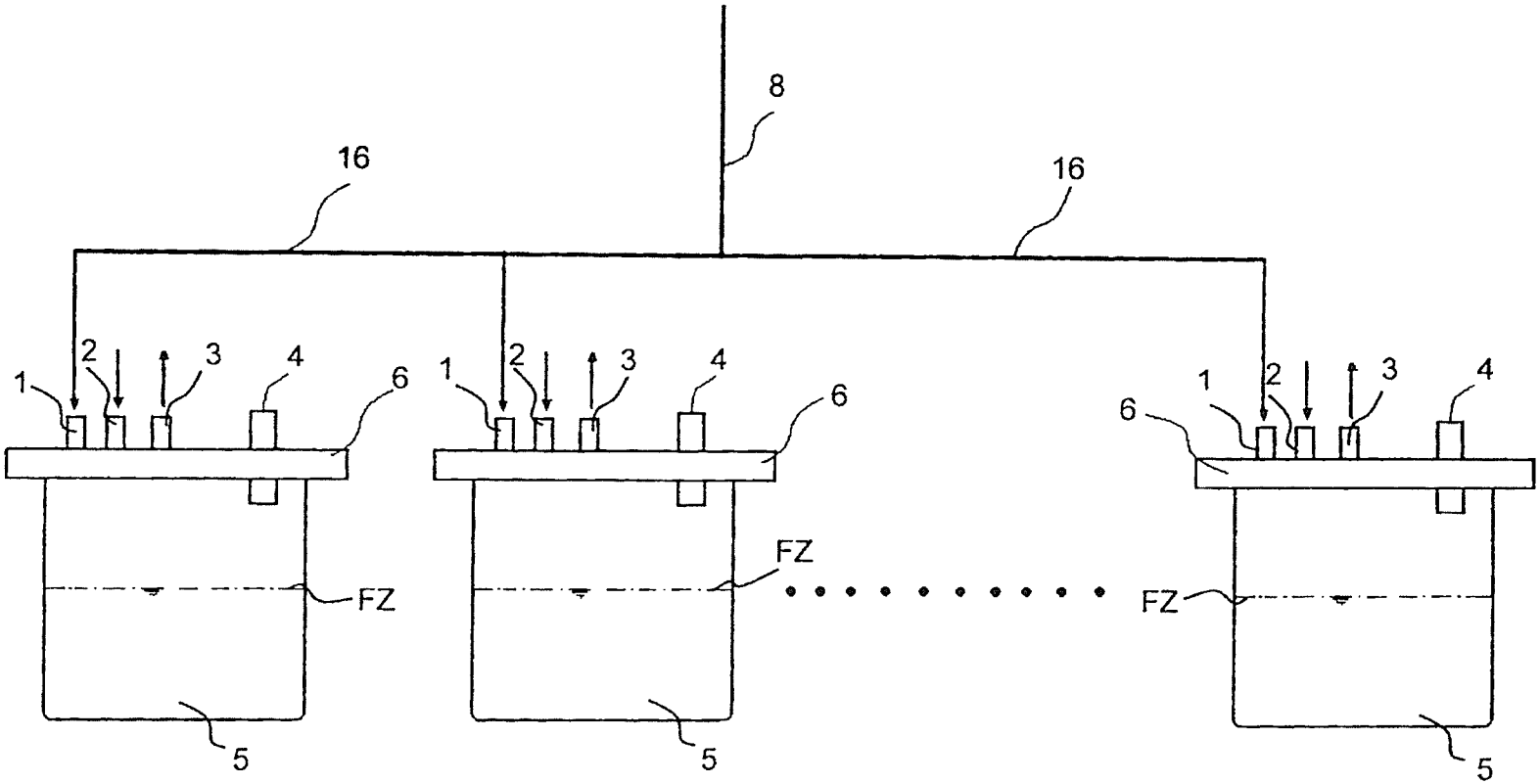
FIG. 2 (PRIOR ART)
FIG. 2 is a basic illustration of a configuration of intermediate tanks for numerous print bars and their connection via pressure lines, without the use of the exemplary embodiment.
Figure 3:
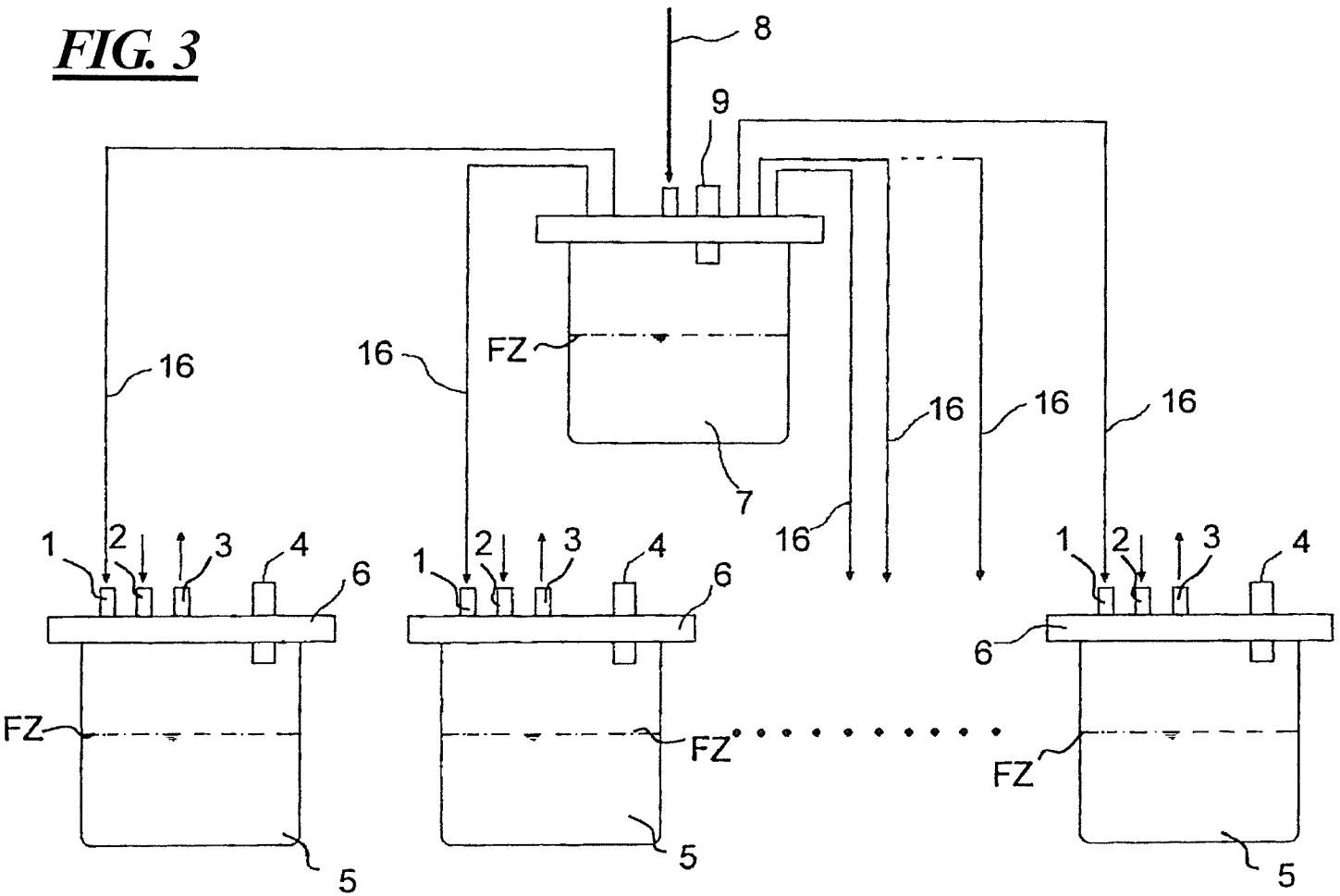
FIG. 3 is a basic illustration of a configuration of intermediate tanks for numerous print bars and their connection via pressure lines, with the use of the exemplary embodiment.

The exemplary embodiments shall be explained in greater detail using FIGS. 1-3.

FIG. 1 shows, schematically, a design for supplying an inkjet printer DG with the necessary colored inks for color printing. An inkjet printer DG is shown having four print bars 11, each having four print heads 12, by means of which a recording medium 10 can be printed. The print bars 11 are each connected by means of a supply line 13 to an ink distribution tank 14. The distribution tank 14 prepares the ink for the printing. The respective distribution tank 14 of a print head 12 is connected to an intermediate tank 5 via a supply line 15. Only one intermediate tank 5 is depicted, as an example, in FIG. 1, although one such intermediate tank 5 is supplied for each distribution tank 14. First, the exemplary embodiment shall be explained based on one print bar 11. The use of the exemplary embodiment with multiple print bars 11 shall be described subsequently, based on FIGS. 2 and 3.

In order to transport ink from the intermediate tank 5 to the distribution tank 14, and to the jets of the print head 12, the ink in the intermediate tank 5 can be subjected to a hydrostatic pressure during the printing operation. To flush the print head 12, an excess pressure is generated in the intermediate tank 5, as a result of which the ink therein can be forced, via the distribution tank 14, to the print heads 12 and their jets. For this, a pressure line 16 leads from a pressure source 17 to the intermediate tank 5.

Each intermediate tank 5 can furthermore be connected to a main tank 18 by means of a supply line 19, in which the print supply for the print bars 11 is contained. A filter 20 and a pump 22 can be incorporated in the supply line 19 between the main tank 18 and the intermediate tank 5. The pump 22 can be controlled thereby, depending on the fill level FZ of the intermediate tank 5, by means of a sensor 4 that checks the fill level FZ. The main tank 18 is filled with new ink using an ink cartridge 10 and a pump 21.

If the sensor 4 malfunctions, for example, during operation, there is the possibility that the pump will pump too much ink into the intermediate tank 5, and an overflow, for example, occurs, as a result of which ink can then end up in the pressure line 16. This is particularly the case during printing, when the pressure source 17 is shut off. There then exists the risk that ink from one intermediate tank 5 may end up in other print bars 11, via the pressure line 16 to the intermediate tanks 5, and mixes there with the dye of this intermediate tank 5. Moreover, the pressure system with the pressure source 17 may fill up with ink, with the consequence that the printer DG may malfunction. Furthermore, the printer DG must subsequently be cleaned with a great deal of expenditure, or it may even be the case that damaged components need to be replaced.

Because one such intermediate tank 5 is provided for each distribution tank 15 in printers DG having numerous print bars 11, the ink of which should be subjected to an excess pressure during the flushing process, it makes sense to connect all of the intermediate tanks 5 to the same pressure source 17 via a shared pressure line 8—see FIG. 2. Each intermediate tank 5 is, e.g. sealed with a lid 6, in which the respective pressure line 16 ends (input 1). Furthermore, an inlet 2 for ink from the main tank 18 is provided through the lid 6, an outlet 3 is provided for the supply line 17 to the distribution tank 14, and a sensor 4 is provided for measuring the fill level FZ in the intermediate tank 5.

If the sensor 4 in the intermediate tank 5 malfunctions during printing operations, there is the risk that ink will be constantly pumped into the intermediate tank 5 by means of the pump 22. When the intermediate tank 5 is then filled up, ink ends up in the pressure line 16, which is connected to this intermediate tank 5. From there, the ink ends up in the other intermediate tanks 5 via the pressure lines 16, and is mixed there with the contents thereof. Furthermore, it is possible that the ink flows via the shared pressure line 8 to the pressure source 17. In addition, ink mixed in this manner can end up in the print heads 12. This is shown in FIG. 2. In this case, the pressure lines 16 for each intermediate tank 5 are connected to one another, and connected by means of a shared pressure line 8 to the pressure source 17.

In order to avoid this problem, an overflow container 7 may be provided in accordance with FIG. 3, to which the pressure lines 16 lead from the intermediate tanks 5. The overflow container 7 is then connected, via the shared pressure line 8, to the pressure source 17, by means of which the compressed air is conducted into the overflow container 7. If then one of the intermediate tanks 5 overflows, the overflowing ink ends up in the overflow container 7 via the pressure line 16, and is collected there. By this means, it is first prevented that the ink can end up in the other intermediate tanks 5 via the pressure lines 16. If, furthermore, a sensor 9 is disposed on the overflow container 7, which measures the fill level FÜ of the overflow container 7, and determines whether the overflow container 7 is full, the printing operation can be shut down, before ink from the overflow container 7 can flow in the pressure lines 16 to the other intermediate tanks 5. By this means it is ensured that, in the case of an overflow of an intermediate tank 5, no ink can flow through the pressure lines 16 and end up in the other intermediate tanks 5, or that ink can end up in the overflow container 7 via the shared pressure line 8.

The components used in the exemplary embodiments, such as, e.g. sensors 4, 9, pumps 22, 21, pressure source 17, distribution tank 14, etc. are of a known design. The components (e.g. components 33, 38) disposed in the intermediate tank 5 in FIG. 1, are insignificant to the function of the exemplary embodiments, and for this reason are not explained.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A system for supplying at least one print head with ink in an inkjet printer, comprising:

an intermediate tank which contains ink for the print head and is connected to the print head via a supply line;

a pressure source connected to the intermediate tank via an overflow container and a pressure line with which an excess pressure is generated in the intermediate tank;

said overflow container accommodating overflowing ink in the pressure line in an event of an overflow of the ink in the intermediate tank; and a sensor disposed at the overflow container which measures an ink fill level of the overflow container and sends out an error message if the overflow container is full.

2. The system according to claim 1 in which the inkjet printer is provided with print bars exhibiting numerous print heads for each print bar, the intermediate tank containing the ink for the print heads of the print bars and which is connected to the print heads of the print bars via the supply line, the intermediate tank being connected to the overflow container via said pressure line, and the overflow container being connected to the pressure source by means of a shared pressure line.

3. The system according to claim 1 in which a plurality of intermediate tanks are provided, one main tank is provided for each intermediate tank for storage of an ink supply and which is connected to the respective intermediate tank by means of a pump, the intermediate tank being provided with a sensor measuring a fill level thereof and which sends out a signal that controls operation of the pump.

4. A method for supplying print bars with a plurality of print heads with ink in an inkjet printer, comprising the steps of:

activating a pressure source in a flushing procedure in order to exert an excess pressure to the ink in intermediate tanks supplying the ink to the print bars such that the ink is flushed through jets of a print head that is to be flushed in the respective print bar;

shutting off the pressure source when printing;

transporting the ink in the intermediate tanks to the print heads of the print bar by means of a hydrostatic pressure;

in an event of an overflow of the intermediate tanks overflowing ink is transported into an overflow container via a respective pressure line connecting the overflow container to the respective intermediate container; and a fill level in the overflow container being measured by means of a sensor, the sensor sending out an error message when the overflow container is full.

5. The method according to claim 4 in which a printing operation of the inkjet printer is stopped if the sensor generates an error message.

6. A system for supplying a plurality of print bars each having print heads with ink in an inkjet printer, comprising:

a plurality of intermediate tanks which contain ink for print heads of print bars connected via respective supply lines to the respective intermediate tanks;

each of the intermediate tanks having an input at which ink is supplied to the respective intermediate tanks;

an overflow container having an input pressure line and also having respective output pressure lines connected to respective intermediate tanks;

each of the intermediate tanks having a respective ink supply inlet;

the overflow container accommodating overflowing ink in the respective pressure lines connected to the respective intermediate containers in event of an overflow of ink in the respective intermediate tank; and a sensor disposed at the overflow container which measures an ink fill level of the overflow container and sends out an error message if the overflow container is full.

7. A method for supplying a plurality of print bars each having print heads with ink in an inkjet printer, comprising the steps of:

providing a plurality of intermediate tanks which contain ink for print heads of print bars connected via respective supply lines to the respective intermediate tanks;

providing each of the intermediate tanks with an input at which ink is supplied to the respective intermediate tanks;

providing an overflow container having an input pressure line and also having respective output pressure lines connected to respective intermediate tanks;

flushing at least one print head connected to a respective intermediate tank by applying pressure through said input pressure line of said overflow container to the respective intermediate tank via the respective output pressure line;

in an event of an overflow in a respective intermediate tank, accommodating in the overflow container overflowing ink in the respective pressure line of the respective intermediate tank; and a fill level in the overflow container being measured by means of a sensor, the sensor sending out an error message when the overflow container is full.

* * * * *